United States Patent [19]

Scherubl

[11] Patent Number: 4,875,702

[45] Date of Patent: Oct. 24, 1989

[54] METHOD OF PRODUCING SKIS AND SKI

[75] Inventor: Franz Scherubl, Radstadt, Austria

[73] Assignee: Atomic Skifabrik Alois Rohrmoser, Austria

[21] Appl. No.: 218,651

[22] Filed: Jul. 13, 1988

[30] Foreign Application Priority Data

Jul. 23, 1987 [AT] Austria ..... 1866/87

[51] Int. Cl.[4] ..... A63C 5/12

[52] U.S. Cl. ..... 280/602; 280/610

[58] Field of Search ..... 280/602, 610

[56] References Cited

U.S. PATENT DOCUMENTS 2,300,786 11/1981 Alley ..... 280/602

3,758,126 9/1973 Zemlin et al. ..... 280/602

4,697,820 10/1987 Hayashi et al. ..... 280/602

FOREIGN PATENT DOCUMENTS 0098831 8/1979 Japan ..... 280/602

87/00763 2/1987 World Int. Prop. O. ..... 280/602

*Primary Examiner*—David M. Mitchell

*Attorney, Agent, or Firm*—Andrus, Sceales, Starke & Sawall

[57] ABSTRACT

A method of producing skis (1) with different vibration absorptions and skis produced by this method. Bores (4) traversing at least one of the side walls (14) are introduced into the core (15) of the ski and are filled with a damping material (5).

16 Claims, 3 Drawing Sheets

METHOD OF PRODUCING SKIS AND SKI

Figure 1:
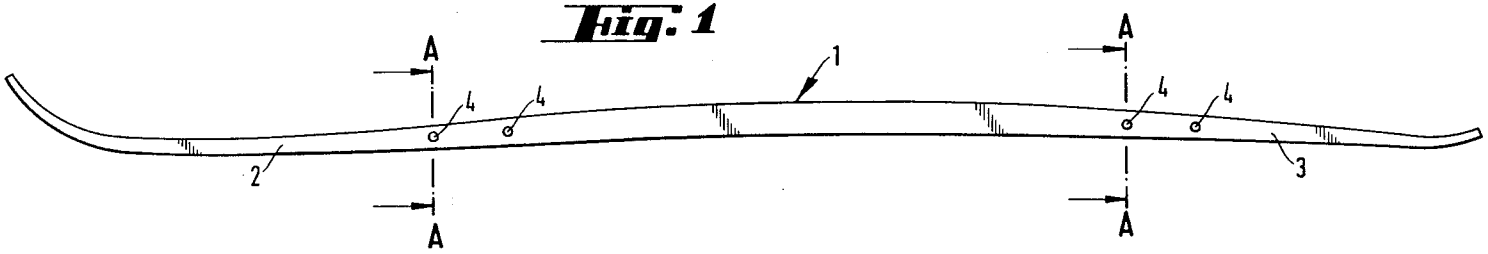

The invention relates to a method of producing skis with different vibration absorptions and to skis produced by this method.

When skis are used for their intended purpose, they are acted upon by shocks or blows as a result of which vibrations are produced which are propagated in the longitudinal direction of the ski. In order to impart satisfactory running characteristics to the skis, it is necessary to absorb these vibrations.

It is known to effect the necessary absorption in that inserts of resilient material are provided inside the skis, between the core and the upper member and/or the lower member. In this case, skis of a series which are made with such inserts have largely the same absorption characteristics. In contrast to this, in so far as there is a requirement, with given materials from which the skis are made, to construct the latter with different absorption characteristics, it is necessary to vary the absorption material, its size or its arrangement in the skis, which would, however, involve heavy production expenditure.

Accordingly, it is the object of the invention to provide a method whereby a subsequent variation in the absorption characteristics of skis can be effected in a simple manner. According to the invention, this is achieved in that bores traversing at least one of the side walls are introduced into the ski core and are then filled with damping material. Thus by this method, the absorption characteristics of finished or nearly finished skis of a given series can be altered subsequently in a simple manner in order to meet special requirements in this respect.

In order to prevent a reduction in the strength of the ski being caused by these bores, the bores are preferably provided at the mid-height of the ski, that is to say in the neutral zone and they extend parallel to the surface of the ski or with only a slight inclination in relation to this. The bores are preferably constructed in the form of blind bores. According to a modified embodiment, however, they may also be made continuous in which case they extend from one side wall to the other.

It is particularly appropriate if these bores are provided in the middle region of the front half of the ski and/or in the middle region of the rear half of the ski. In this case, the bores extending from the one longitudinal side of the ski may be staggered in the longitudinal direction of the ski in relation to the bores originating from the other longitudinal side of the ski. Furthermore, the bores may be aligned perpendicular to the longitudinal direction of the ski or they may form an acute angle of preferably 30° to 60° particularly of 45°, with the longitudinal direction of the ski.

The invention further relates to a ski having an upper member, having a lower member, having side walls, having a core, having lateral protective edges and having a running surface, wherein, in order to achieve special absorption characteristics, according to the invention, the core is constructed with bores traversing at least one of the side walls and filled with damping material.

The subject of the invention is explained in more detail below with reference to examples of embodiment illustrated in the drawing.

Figure 2:
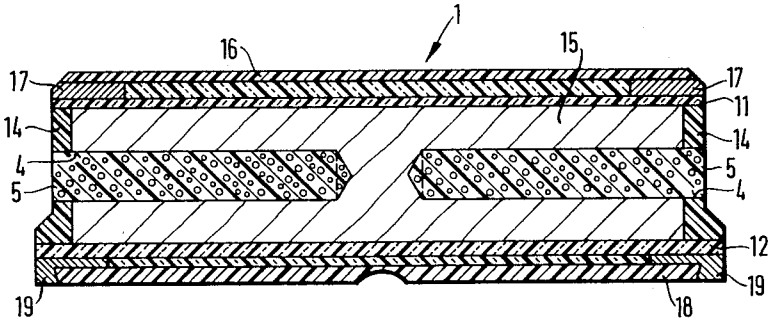
Figure 3:
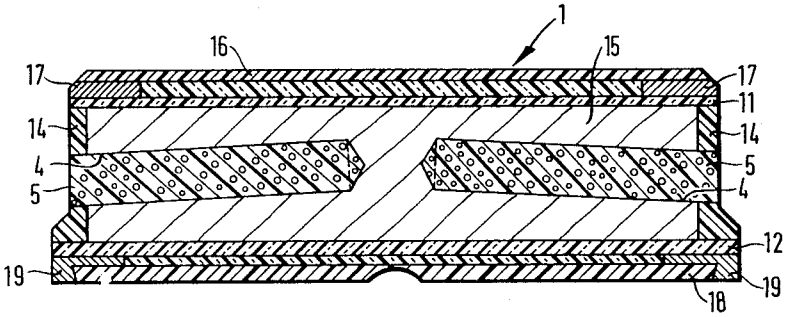

FIG. 1 shows a ski produced by the method according to the invention, in side view, FIG. 2 shows the section on the lines A-A of Figure 1, illustrated on a larger scale in relation to this, FIG. 3 shows a modified embodiment of FIG. 2 and FIGS. 4 to 8 show modified embodiments of skis which are produced by the method according to the present invention.

In FIG. 1, a ski 1 according to the present invention is illustrated in side view and is constructed, in the middle region of its front half 2 and in the middle region of its rear half 3 with bores 4 which are introduced into the core of the ski and which traverse at least one of the two side walls.

As can be seen from FIG. 2, a ski 1 according to the present invention consists in known manner of an upper member 11, a lower member 12, of side walls 14, of a core 15, of a covering layer 16, of upper lateral edges 17, of a running surface 18 and of lower protective edges 19. Layers of resilient material through which an absorption is caused may possibly be provided between the core 15 and the upper member 11 and/or the lower member 12.

In order to be able to influence nearly finished skis of a series in their absorption characteristics, bores 4 traversing the side walls 14 are introduced into the core 15 in the middle region of the front half 2 of the ski 1 and in the middle region of the rear half 3 of the ski 1, which bores are filled with a damping material 5. In order to rule out the possibility of the strength of the ski 1 being reduced by these bores 4, these are provided approximately at the mid-height of the ski 1 and extend subdstantially parallel to or - as illustrated in FIG. 3 - at a slight angle to the surface of the ski.

Figure 4:
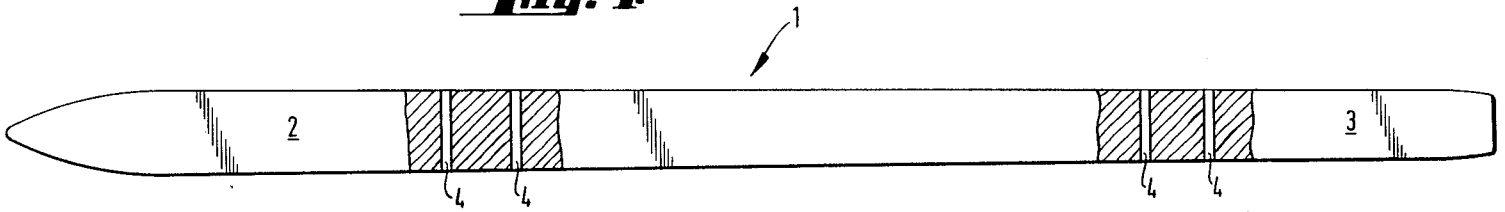
Figure 5:
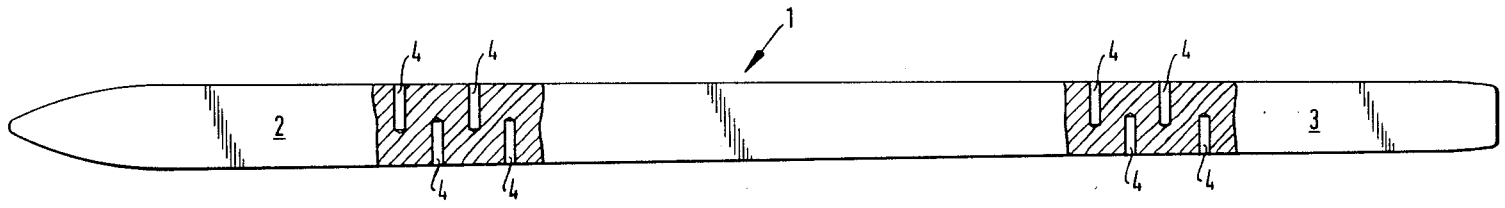
Figure 6:
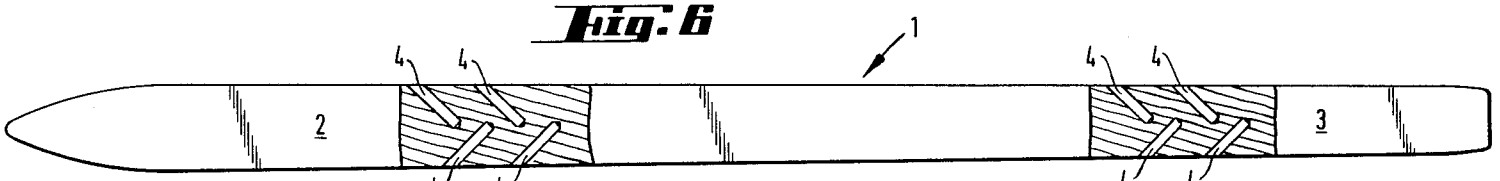
Figure 7:
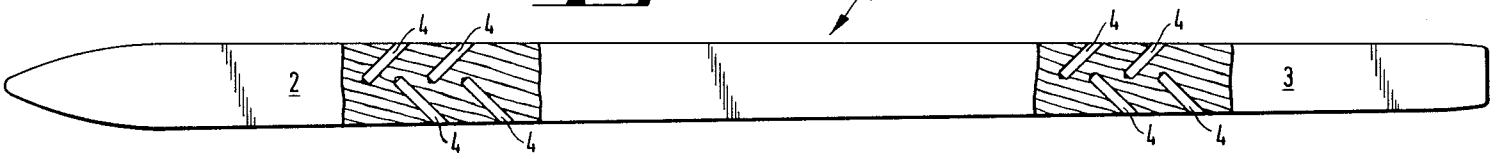
Figure 8:
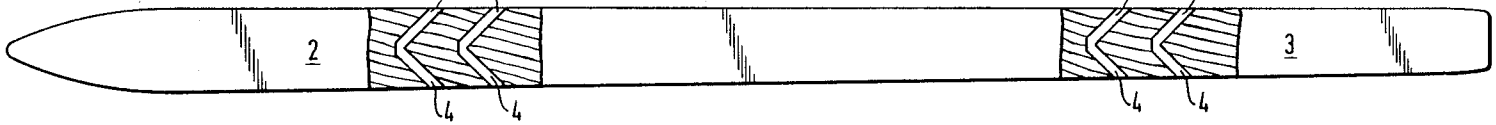

As can be seen from FIG. 4, these bores 4 may be aligned substantially perpendicular to the longitudinal direction of the ski and traverse the ski 1 from one side wall to the other. As can be seen from FIG. 5 of the drawing, these bores 4 may be constructed in the form of blind bores in which case the bores originating from the two side walls are staggered in relation to one another in the longitudinal direction of the ski 1. As can be seen from FIGS. 6 and 7, these bores 4 may be constructed in the form of blind bores which form an acute angle of about 45° with the longitudinal direction of the ski. As can be be seen from FIG. 8, these bores 4 may form an angle of about 45° in relation to the longitudinal direction of the ski, as a result of which they merge into one another. All the bores 4 are filled with a resilient material by means of which a high absorption is caused.

Since the absorption characteristics can be influenced by the number of bores 4, by the diameter of the bores 4 and by the length of the bores, skis of one series, which originally had the same absorption characteristics, can be constructed with absorption characteristics which are graduated in relation to one another, by varying these parameters, without a change having to be made in the production process during the production of the skis as a result.

The individual components of the ski consist of the following materials:

The covering layers 16 and the side walls 14 are made of a phenolic resin. The upper member 11 and the lower member 12 consist of fibre-glass. The running surface 18 is made of polyethylene. The core 15 consists of bonded layers of wood. A foamed plastics material 5 is introduced into the bores 4. Further layers of fibre-glass may be provided between the covering layers 16 and the upper member 11 and between the running surface 18 and the lower member 12.

I claim:

1. A method of providing individualized vibration absorption properties to a mass produced ski in the concluding stages of its production, said ski having a core extending in the longitudinal direction of the ski, a running surface, and side walls; said method comprising the steps of:

manufacturing the ski to its essentially completed state, and thereafter;

introducing bores in the ski extending from at least one side wall into the core, said bores being generally straight and lying at a constant angle of at least 30° to the longitudinal direction of the ski, said bores terminating in one of the core and the opposite side wall of said ski, the extension of the bores in the core being completely surrounded by the core; and filling the bores with a vibration damping material, the number and configuration of said bores and the properties of said material providing the individualized vibration absorption properties to the ski.

2. A method according to claim 1 further defined as introducing the bores at substantially the mid-height of the ski and to extend parallel to the running surface of the ski.

3. A method according to claim 1 further defined as introducing the bores at substantially the mid-height of the ski and to extend with a slight inclination to the running surface of the ski.

4. A method according to claim 1 further defined as introducing the bores in at least one of the middle region of the front half of the ski and the middle region of the rear half of the ski.

5. A method according to claim 1 further defined as introducing bores from both side walls of the ski, the bores extending from one side wall being staggered, in the longitudinal direction of the ski, in relation to the bores extending from the other side wall.

6. A method according to claim 1 further defined as introducing the bores to extend perpendicular to the longitudinal direction of the ski.

7. A method according to claim 1 further defined as introducing the bores to extend at an angle of between 30° and 60° to the longitudinal direction of the ski.

8. A method according to claim 7 further defined as introducing the bores to extend at an angle of 45° to the longitudinal direction of the ski.

9. In a mass produced ski having a core extending in the longitudinal direction of the ski, a running surface, and side walls adjacent said core, an improvement providing individualized vibration absorption properties to said ski, said improvement comprising:

bores in the ski extending from at least one side wall into the core, said bores being generally straight and lying at a constant angle of at least 30° to the longitudinal direction of the ski, said bores terminating in one of said core and the opposite side wall of said ski, the extension of said bores in said core being completely surrounded by the core; and a filling of vibration damping material in said bores.

10. A ski according to claim 9 further defined in that said bores are located at substantially the mid-height of the ski and extend parallel to the running surface of the ski.

11. A ski according to claim 9 further defined in that said bores are located at substantially the mid-height of the ski and extend with a slight inclination to the running surface of the ski.

12. A ski according to claim 9 further defined in that the bores are located in at least one of the middle region of the front half of the ski and the middle region of the rear half of the ski.

13. A ski according to claim 9 further defined in that bores extend from both side walls of the ski, the bores extending from one side wall being staggered, in the longitudinal direction of the ski, in relation to the bores extending from the other side wall.

14. A ski according to claim 9 further defined in that the bores extend perpendicularly to the longitudinal direction of the ski.

15. A ski according to claim 9 further defined in that the bores extend at an angle of between 30° and 60° to the longitudinal direction of the ski.

16. A ski according to claim 15 further defined in that the bores extend at an angle of 45° to the longitudinal direction of the ski.

* * * * *